US009599335B2

(12) United States Patent
Mine et al.

(10) Patent No.: US 9,599,335 B2
(45) Date of Patent: Mar. 21, 2017

(54) SOLID-FUEL BURNER

(71) Applicant: MITSUBISHI HITACHI POWER SYSTEMS, LTD., Kanagawa (JP)

(72) Inventors: Toshihiko Mine, Hiroshima (JP); Kenji Kiyama, Hiroshima (JP); Miki Shimogori, Hiroshima (JP); Satoshi Tadakuma, Hiroshima (JP); Hitoshi Wakamatsu, Hiroshima (JP); Noriyuki Ohyatsu, Hiroshima (JP); Koji Kuramashi, Hiroshima (JP); Kenichi Ochi, Hiroshima (JP); Yusuke Ochi, Hiroshima (JP); Hirofumi Okazaki, Ibaraki (JP)

(73) Assignee: MITSUBISHI HITACHI POWER SYSTEMS, LTD., Kanagawa (JP)

( * ) Notice: Subject to any disclaimer, the term of this patent is extended or adjusted under 35 U.S.C. 154(b) by 22 days.

(21) Appl. No.: 14/421,003

(22) PCT Filed: Aug. 9, 2013

(86) PCT No.: PCT/JP2013/071593

§ 371 (c)(1),
(2) Date: Feb. 11, 2015

(87) PCT Pub. No.: WO2014/027609

PCT Pub. Date: Feb. 20, 2014

(65) Prior Publication Data

US 2015/0241058 A1 Aug. 27, 2015

(30) Foreign Application Priority Data

Aug. 14, 2012 (JP) ..... 2012-179672

(51) Int. Cl.
*F23D 1/00* (2006.01)
*F23K 3/02* (2006.01)
*F23C 7/00* (2006.01)

(52) U.S. Cl.
CPC ..... *F23D 1/00* (2013.01); *F23C 7/006* (2013.01); *F23C 7/008* (2013.01); *F23K 3/02* (2013.01);

(Continued)

(58) Field of Classification Search
CPC ..... F23D 1/00; F23D 1/06; F23K 3/02; F26K 2203/008; F26K 2203/006; F26K 2203/201

(Continued)

(56) References Cited

U.S. PATENT DOCUMENTS 5,937,770 A * 8/1999 Kobayashi ..... F23D 1/00 110/104 B
2010/0064986 A1* 3/2010 Kiyama ..... F23D 1/00 122/16.1

(Continued)

FOREIGN PATENT DOCUMENTS

JP 59-163709 11/1984
JP 04-268103 9/1992

(Continued)

OTHER PUBLICATIONS

Official Action, with English-language translation, for JP App. No. 2014-530535 having a mailing date of Feb. 3, 2015.

(Continued)

*Primary Examiner* — David J Laux
(74) *Attorney, Agent, or Firm* — Greenblum & Bernstein, P.L.C.

(57) ABSTRACT

A solid-fuel burner includes: a venturi having a constricting portion where the transverse cross section of a fuel passage is reduced in a fuel nozzle for supplying a solid fuel; and a fuel concentrator for diverting the flow in the nozzle outward in the wake side of the venturi, and the nozzle is formed so that (a) the aperture in the vicinity of an opening portion of a boiler furnace wall surface has a flat shape, (b) cross-sectional shape thereof orthogonal to a nozzle center axis C on the outer peripheral wall of the nozzle is circular in a transverse cross section up to the constricting portion of (Continued)

the venturi, (c) a portion that has a gradually increasing degree of flatness is provided between the constricting portion and the opening portion, and (d) the flat shape in the opening portion is where the degree of flatness reaches a maximum.

10 Claims, 18 Drawing Sheets

(52) U.S. Cl.
CPC .... *F23D 2201/20* (2013.01); *F23K 2203/008* (2013.01); *F23K 2203/201* (2013.01)

(58) Field of Classification Search
USPC ..... 110/104 B, 261, 263, 265
See application file for complete search history.

(56) References Cited

U.S. PATENT DOCUMENTS

2011/0053102 A1* 3/2011 Okazaki ..... F23C 7/008 431/12
2011/0210191 A1* 9/2011 Adam ..... B05B 1/00 239/591
2012/0103237 A1* 5/2012 Jones ..... F23D 1/00 110/297

FOREIGN PATENT DOCUMENTS

| | | |
|---|---|---|
| JP | 2007-57228 | 3/2007 |
| JP | 2011-202841 | 10/2011 |
| JP | 2011/202841 | 10/2011 |
| JP | 4896143 | 3/2012 |
| WO | 2008/038426 | 4/2008 |
| WO | 2009/041081 | 4/2009 |
| WO | 2009/125566 | 10/2009 |
| WO | 2012/098848 | 7/2012 |

OTHER PUBLICATIONS

Official Action, with English-language translation, for JP App. No. 2014-530535 having a mailing date of Jun. 16, 2015.
International Search Report for PCT/JP2013/071593 having a mail date of Nov. 5, 2013, along with English-language translation thereof.

* cited by examiner

FIG.2(c)
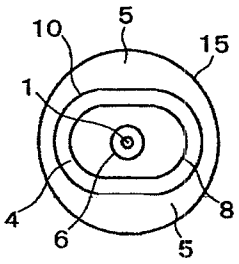
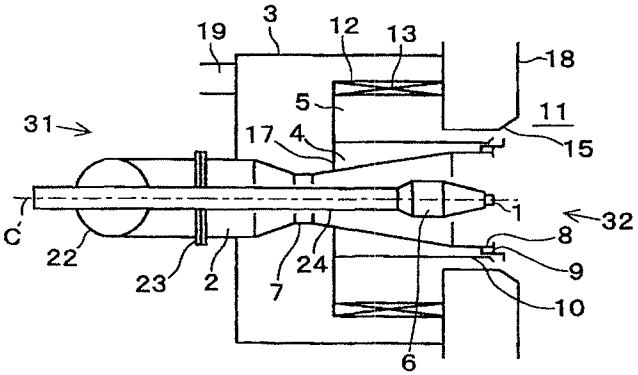
FIG.2(d)
FIG.2(a)
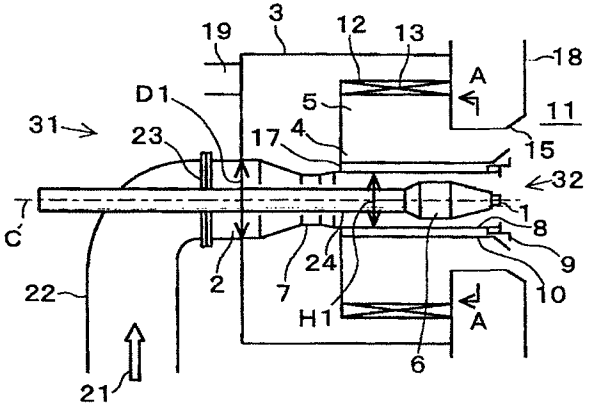
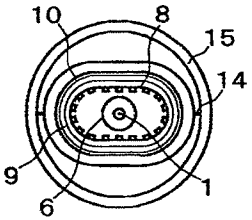
FIG.2(b)

FIG.3(a)
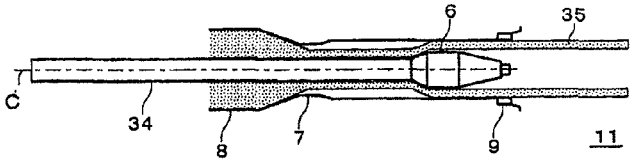
FIG.3(b)
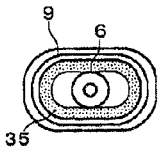
FIG.3(c)
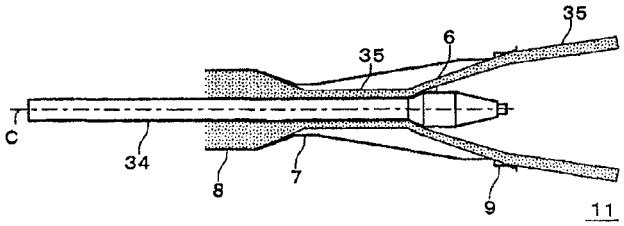
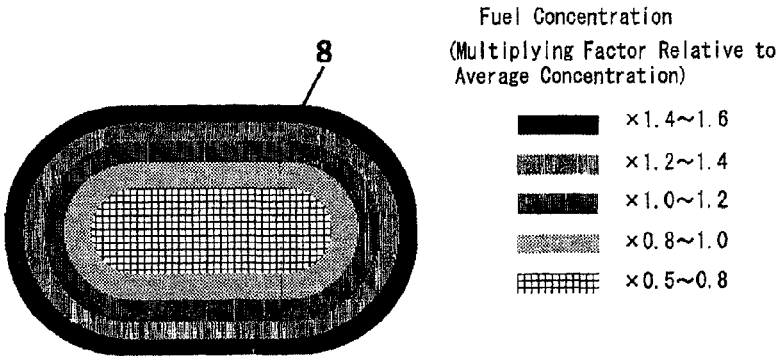
FIG.3(d)

SOLID-FUEL BURNER

TECHNICAL FIELD

The present invention relates to a solid-fuel burner, and more particularly to a burner that enables low-nitrogen oxide (NOx) combustion with excellent solid fuel efficiency.

BACKGROUND ART

In general, a cross section of an outlet portion of a fuel nozzle of a solid-fuel burner has a shape close to a circle or a square, and a considerable distance is required for a flame ignited outside a fuel containing fluid jet to be propagated to a central portion of the fuel containing fluid jet in some situations. A distance along which an ignited flame in a jetting direction of the fuel containing fluid from the fuel nozzle is propagated to the central portion of the fuel containing fluid jet, i.e., an unfired distance increases as a diameter or an outer diameter portion of the fuel nozzle enlarges, and an unfired region expands. Promoting combustion in a reduction region near the burner is important to suppress generation of NOx in a combustion gas, but an increase in unfired region means a reduction in combustion time after ignition, and it can be a cause of insufficient suppression of NOx or a reduction in combustion efficiency.

In a boiler plant equipped with a plurality of solid-fuel burners as combustion apparatuses, although increasing a burner capacity is an effective technique for improvement of operability based on a reduction in cost and a decrease in the number of burners, there is a problem that the diameter or a length of the outer diameter portion of each fuel nozzle increases and an unfired region expands, which results in a cause of an increase in NOx and a reduction in combustion efficiency.

This problem is caused by a large distance from a fired region on a fuel containing fluid jet surface to the central portion of the fuel containing fluid jet.

WO2008-038426A1 (Patent Literature 1) discloses an invention that is the prior art according to the invention of the present applicant and that suppresses an unfired region while raising a burner capacity by a burner in which an outlet shape of a transverse cross section of a fuel nozzle is a rectangular shape having a long-diameter portion and a short-diameter portion, an elliptic shape, or a substantially elliptic shape and achieves prevention of an increase in NOx concentration in a combustion gas and a reduction in combustion efficiency of a fuel.

Further, WO2009-125566A1 discloses an opening shape of a burner similar to the above invention.

Furthermore, in a boiler plant, in a case where a fluid passes through a fluid passage for using vapor obtained by heating a fluid flowing through a plurality of heat transfer tubes by a high-temperature exhaust gas provided by solid-fuel burners in a boiler furnace and a complicated fluid passage for recycling the obtained vapor, obtaining a specific heat transfer quantity to a fluid in a heat transfer portion where each heat transfer tube is installed is important, and hence a temperature of the combustion gas and a flow rate of the fluid must be controlled with respect to each heat transfer portion. Therefore, there is an invention that can control a heat transfer quantity to a fluid in each heat transfer tube by changing a combusting position of a fuel in a furnace (WO2009-041081A1). In an example described in this invention, a gas jet nozzle outlet provided to a solid-fuel burner is divided into two, upper and lower pieces, and independently adjusting respective air flow rates enables changing a combusting position of the fuel vertically.

It is to be noted that the boiler that uses a solid fuel generally uses pulverized coal as the solid fuel, and hence such a boiler may be referred to as a pulverized coal burning boiler and a solid-fuel burner will be referred to as a pulverized coal burner hereinafter. At the time of starting the pulverized coal burning boiler, fans are activated, and air is supplied as a combustion gas to a plurality of pulverized coal burners installed in a boiler furnace and two-staged combustion air ports. Subsequently, a flame is formed with respect to a pilot torch of each burner, and a frame detector (which will be referred to as an FD hereinafter) detects this flame, and then a liquid fuel jetted from each ignition burner is ignited by the flame of each pilot torch to form the flame with respect to each ignition burner. After the FD detects the formation of the flame using the ignition burner, the fire of each pilot torch is extinguished, and a pilot torch gun is removed to the outside of the furnace to prevent burnout.

Then, a temperature of the furnace is increased by the ignition burner until a furnace outlet temperature reaches a set temperature, and a mill is activated to gradually switch to pulverized coal combustion. That is, in the pulverized coal burner, to ignite the pulverized coal, each ignition burner using a liquid fuel or the like is installed, and the pilot torch that ignites this ignition burner and the FD that detects flames are further installed.

As the pulverized coal burners, there is used a pulverized coal burner that has an ignition burner installed at the center, allows pulverized coal and primary air as a carrier gas to flow from the periphery of the ignition burner and ejects them into a furnace, and supplies combustion air from the periphery. In this case, to prevent a flow of the pulverized coal from being disturbed and avoid deposition of the pulverized coal or a flame stabilization failure in the burner, the pilot torch and the FD are installed in a combustion air supply unit at the periphery rather than a pulverized coal outlet portion.

If the FD or the pilot torch is installed in the combustion air supply unit like the prior art, there is a situation that an installation site may affect the flame detection using the FD or stable ignition and flame stabilization in the ignition burner using the pilot torch.

Further, there is also known that a flame detector is arranged in a tertiary air flow path in a pulverized coal burner (Japanese Unexamined Patent Application Publication No. Hei 4-268103).

CITATION LIST

Patent Literatures

Patent Literature 1: WO2008-038426A1
Patent Literature 2: WO2009-041081A1
Patent Literature 3: WO2009-125566A1
Patent Literature 4: Japanese Unexamined Patent Application Publication No. Hei 4-268103

DISCLOSURE OF INVENTION

Problem to be Solved by the Invention

Patent Literature 1 discloses the prior art concerning the invention of the present applicant, which is a burner in which an outlet shape of a transverse cross section of a fuel nozzle 1 is a rectangular shape having a long-diameter portion and a short-diameter portion, an elliptic shape, or a substantially elliptic shape having a long-diameter portion and a short-diameter portion.

According to this burner, shortening a distance from a fired region on a surface of a fuel containing fluid jet to a central portion of the fuel containing fluid jet enables reducing an unfired region and assuring a combustion time after ignition.

However, as a result of continuous studies conducted by the present applicant, it was revealed that, in a burner in which an opening shape of a fuel nozzle near an opening portion of a boiler furnace wall surface is a "flat shape", intentionally shortening a distance from an outer peripheral side that is an ignition source of the fuel containing fluid jet to a central portion side to form a flame having a flat shape similar to the shape of the fuel nozzle opening is difficult when the fuel nozzle opening shape is just formed into the flat shape.

As a reason for this, in case of a solid-fuel burner, it can be considered that inertia force of fuel particles is higher than that of a gas or a liquid and the fuel particles are not necessarily uniformly dispersed along the nozzle shape within a short distance of the nozzle and that the fuel is widely dispersed in a width direction as compared with a nozzle having the same capacity and a perfect circular shape, for example. In particular, in a low-load region where a burner output is reduced, since a fuel flow rate decreases, this problem becomes prominent. As a result, there is concern that an ignition state is partially insufficient as seen in a nozzle circumferential direction and a region which might lead to an increase in generation of unburned combustibles is produced.

That is because a fuel containing fluid jet must flow with a short fuel nozzle distance (a length in the axial direction; e.g., 3 m) so as to spread in the "flat shape" at a high velocity of approximately 25 m/s near a connecting portion of a cylindrical carrier piping.

That is, it was revealed that the solid fuel has the higher inertial force than that of a carrier fluid, high fuel concentration at the central portion in the wide width direction where the fuel can readily flow, and low fuel concentration at both end portions in the wide width direction where the fuel is hard to flow, and hence a fuel concentration distribution in the fuel containing fluid is apt to be produced in the wide width direction in the cross section of the opening of the fuel nozzle outlet portion.

Although a fuel/oxygen stoichiometric ratio is extremely low in a portion of the fuel nozzle having low fuel concentration and the fuel/oxygen stoichiometric ratio is extremely high in a portion of the same having high fuel concentration, the fuel concentration distribution can be substantially uniformed with respect to the fuel nozzle circumferential direction, and mixture of the combustion gas from (the combustion gas nozzle (which is mainly a secondary air nozzle) of) the outer periphery into the fuel containing fluid can be substantially uniformed at the fuel nozzle outer peripheral portion.

Furthermore, Patent Literature 1 has a description of a configuration characterized in that a fluid distribution plate that equally distributes a fuel in a fuel nozzle is provided at an inlet portion of the fuel nozzle. This fluid distribution plate has an effect of suppressing a deviation of fuel concentration in a short-diameter direction by simply causing a fuel containing fluid to collide and disperse, but it does not have a function of uniforming the fuel concentration in a long-diameter direction. As a result, as shown in FIG. 18(*c*) and FIG. 18(*d*), the fuel concentration at a fuel nozzle outlet portion forms a distribution that is high at the central portion in the long-diameter direction and low at both ends.

Moreover, a flow of a combustion gas (air) jetted from the solid-fuel burner is greatly affected by a configuration of the burner, especially a conformation of a passage of the combustion gas. In particular, in the solid-fuel burner in which a cross-sectional shape of a solid-fuel nozzle orthogonal to a flow of a fluid is flat, a drift current is apt to be generated. When the drift current is generated in this manner, there occurs a problem that stability of flames from the burner becomes poor. Among others, a flow at the outer peripheral portion of a solid-fuel nozzle outlet or near a flame stabilizer installed in this portion is important. That is, it is important to equally distribute in a circumferential direction the jet of the combustion gas jetted from the outer peripheral portion of the solid-fuel nozzle and concentrate a mixed fluid of a fuel and a carrier gas to the fuel concentration that is sufficient for ignition/flame stability in a region close to the outer peripheral portion of the nozzle outlet in a radial direction extending from a center axis of the fuel nozzle toward the outer peripheral portion or the flame stabilizer (near an inner wall of the fuel nozzle).

Moreover, in the invention disclosed in Patent Literature 3, although the FD or the pilot torch is installed in the combustion air supply unit at the outer periphery of the pulverized coal supply nozzle, an installation site in the circumferential direction is not specified. No problem occurs if the pulverized coal nozzle and the combustion air supply port have the concentric shapes, but a problem that is a difficulty in detection of stable flames or ignition of the ignition burner from the pilot torch occurs if the shape of the pulverized coal supply nozzle outlet is a rectangular shape, an elliptic shape, or a substantially elliptic shape.

It is an object of the present invention to provide a solid-fuel burner that can provide fuel concentration sufficient for ignition/flame stabilization of a fuel and achieve low-NOx concentration of a combustion exhaust gas while uniforming the fuel concentration in a circumferential direction at a fuel nozzle outlet.

Means for Solving Problem

The object of the present invention can be achieved by the following solving means.

The invention according to a first aspect provides a solid-fuel burner comprising: a fuel nozzle (8) that is opened in a furnace wall surface (18) having a solid-fuel passage (2) connected to a cylindrical fuel carrier piping (22) through which a mixed fluid of a solid fuel and a carrier gas for the solid fuel flows; and one or more combustion gas nozzles (10, 15) that communicate with a wind box (3) in which a combustion gas for the solid fuel flows and are formed on an outer peripheral wall side of the fuel nozzle (8), wherein the solid-fuel burner comprises in the fuel nozzle (8): a venturi (7) having a constricting portion that reduces a transverse cross section of the solid-fuel passage (2) in the fuel nozzle (8); and a fuel concentrator (6) that diverts a flow in the nozzle outward on a wake side of the venturi (7), and the fuel nozzle (8) is formed so that (a) an opening shape thereof near an opening portion (32) in the boiler furnace wall surface (18) is a flat shape, (b) a cross-sectional shape thereof orthogonal to a nozzle center axis (C) on the outer peripheral wall of the fuel nozzle (8) is a circular shape in a transverse cross section up to the constricting portion of the venturi (7), (c) a portion where a degree of flatness gradually increases is provided between the constricting portion of the venturi (7) and the opening portion (32)

provided in the boiler furnace wall surface (18), and (d) the opening portion (32) in the boiler furnace wall surface (18) is formed into a flat shape having the maximum degree of flatness.

The invention according to a second aspect provides the solid fuel burner according to the first aspect, wherein a flame stabilizer (9) is disposed at an outer periphery of a tip of the outer peripheral wall of the fuel nozzle (8).

The invention according to a third aspect provides the solid-fuel burner according to the first or the second aspect, wherein a secondary combustion gas passage (4) provided in a secondary combustion gas nozzle (10) disposed on the innermost side in the plurality of combustion gas nozzles (10, 15) has a cross-sectional shape orthogonal to the center axis (C) of the outer peripheral wall of the secondary combustion gas nozzle (10), being formed into a flat shape at an outlet portion of the secondary combustion gas passage (4).

The invention according to a fourth aspect provides the solid-fuel burner according to the third aspect, wherein a tertiary combustion gas passage (5) in a tertiary combustion gas nozzle (15) disposed on the outermost side in the plurality of combustion gas nozzles (10, 15) has a cross-sectional shape orthogonal to the center axis (C) of the outer peripheral wall of the tertiary combustion gas nozzle (15), being formed into a circular at an outlet portion of the tertiary combustion gas passage (5) near the furnace wall surface (18).

Here, the "flat shape" is defined as a rectangular shape shown in FIG. 1(*a*), an elliptic shape shown in FIG. 1(*b*), a shape combining a semicircular shape and a rectangular shape shown in FIG. 1(*c*), or a shape of a wide polygon shown in FIG. 1(*d*), i.e., a flat shape having a long diameter or a long side W and a short diameter or a short side H.

In FIG. 1(*a*), some or all of four corners may be curved. Likewise, in FIG. 1(*d*), some or all of corner portions of the polygon may be curved. Additionally, in each of the above-described shapes, a curvature of the curved portion is not restricted to a fixed curvature.

Further, the "degree of flatness" is defined as a ratio W/H of the long diameter or the long side W and the short diameter or the short side H. Therefore, a gradual increase in degree of flatness means that a ratio W/H of a cross section orthogonal to a center axis (C) of the fuel nozzle (8) gradually increases, and the maximum flat shape means a shape of the portion having the largest ratio W/H in the fuel nozzle (8).

In practice, the ratio W/H in the furnace opening portion (32) of the fuel nozzle (8) is set to fall within a range of 1.5 to 2.5. When the ratio W/H is lower than approximately 1.5, low NOx combustion performance cannot be achieved with high efficiency according to the present invention because an increase in degree (ratio) of flatness is not enough and spread of flames in the wide width direction in the furnace (11) is small. Further, when the ratio W/H is higher than approximately 2.5, a dimension of the long diameter or the long side W at the outlet of the fuel nozzle (8) is too large, and installing the fuel nozzle (8) in the burner opening is difficult.

The invention according to a fifth aspect provides the solid-fuel burner according to the third or the fourth aspect, wherein the secondary combustion gas passage (4) has a configuration in which the cross-sectional area of the passage is sequentially reduced from a combustion gas inflow portion (17) toward the opening portion (32) in the furnace wall surface (18).

The invention according to a sixth aspect provides the solid-fuel burner according to the third or the fourth aspect, wherein a gas inflow direction of the combustion gas inflow portion (17) of the secondary combustion gas passage (4) is set to a direction vertical to the furnace wall surface (18), and a flat plate (17*a*, 17*b*) having a plurality of opening portions (17*aa*, 17*ba*) is arranged in the combustion gas inflow portion (17).

The invention according to a seventh aspect provides the solid-fuel burner according to the sixth aspect, wherein the opening portions (17*aa*, 17*ba*) of the flat plates (17*a*, 17*b*) arranged in the combustion gas inflow portion (17) of the secondary combustion gas passage (4) are arranged in such a manner that a flow velocity of the combustion gas in the secondary combustion gas passage (4) becomes uniform in a circumferential direction of the passage (4).

The invention according to an eighth aspect provides the solid-fuel burner according to the sixth aspect, wherein an aperture ratio of the opening portions (17*aa*, 17*ba*) of the flat plates (17*a*, 17*b*) relative to a cross-sectional area of the combustion gas inflow portion (17) of the secondary combustion gas passage (4) is set to 0.05 to 0.30.

The invention according to a ninth aspect provides the solid-fuel burner according to the fifth aspect, wherein a reduction ratio of a passage cross-sectional area of the secondary combustion gas passage (4) from the combustion gas inflow portion (17) of the secondary combustion gas passage (4) to the outlet portion is set to 30% to 80%.

The invention according to a tenth aspect provides the solid-fuel burner according to the first aspect, wherein a flame detector (40) and a pilot torch (41) are disposed on both ends on a long side when a shape of the outlet of the fuel nozzle (8) that emits the solid fuel and the solid fuel carrier gas is a rectangular shape, on focuses when a shape of the outlet of the fuel nozzle (8) is an elliptic shape, and on both ends of a linear portion when a shape of the outlet of the fuel nozzle (8) is a substantially elliptic shape having the linear portions and circular portions.

Effect of the Invention

According to the invention described in the first aspect, since the fuel containing fluid is supplied to the furnace (11) while uniformly maintaining the fuel concentration distribution in the fuel containing fluid near the inner wall of the fuel nozzle (8), the oxygen stoichiometric ratio near the inner peripheral wall of the fuel nozzle (8) becomes adequate over the entire inner circumference, and combustion of the fuel having low NOx concentration can be achieved with high efficiency.

According to the invention described in the second aspect, in addition to the effect of the invention described in a first aspect, installation of the flame stabilizer (9) facilitates ignition of the fuel near the fuel nozzle (8), and combustion of the fuel having the low NOx concentration is further promoted with high efficiency.

According to the invention described in the third aspect, in addition to the effect of the invention described in the first or the second aspect, when the cross-sectional shape orthogonal to the center axis (C) of the outer peripheral wall of the secondary combustion gas nozzle (10) is formed into the flat shape at the nozzle outlet so that the gap between the flame stabilizer (9) and the secondary combustion gas nozzle (10) to which the secondary combustion gas is supplied is uniformly formed over the entire circumference, the secondary combustion gas can be uniformly supplied in accordance with the uniform fuel concentration distribution formed near the inner peripheral wall of the fuel nozzle (8). That is, since the local fuel/combustion gas flow ratio of the fuel in a region having the high fuel concentration near the inner peripheral wall of the fuel nozzle (8) and the secondary combustion gas on the outer side surrounding the region can be uniformed in the entire circumferential region of the outlet portion of the fuel nozzle (8), optimum combustion can be obtained in the entire circumferential region.

According to the invention described in the fourth aspect, in addition to the effect of the invention described in the third aspect, the tertiary combustion gas nozzle (15) has the circular outlet shape and the tertiary combustion gas passages (5) are vertically arranged to sandwich the long diameter or the long side W of the fuel nozzle (8) having the flat shape, mixture of the tertiary combustion gas and the fuel is suppressed as compared with a case where the tertiary combustion gas nozzle (15) also has the same flat shape as those of the fuel nozzle (8) and the secondary combustion gas nozzle (10), and the fuel excess region (a reduction region) in the central portion of the burner enlarges, facilitating low-NOx combustion.

Furthermore, when the outlet shape of the tertiary combustion gas nozzle (15) on the outermost periphery is the circular shape, it can be easily applied to a newly configured burner but also remodeling of an existing burner having a circular burner opening portion.

According to the invention described in the fifth aspect, in addition to the effect of the invention described in the third or a fourth aspect, when the cross-sectional area of the passage (4) is sequentially reduced from the combustion gas inlet portion (17) of the secondary air passage (4) toward the outlet portion which is a jet port leading to the furnace (11), a flow velocity sequentially approaches uniformity in the circumferential direction toward the outlet portion of the secondary air passage (4).

According to the invention described in the sixth aspect, in addition to the effect of the invention described in the third or the fourth aspect, since the combustion gas inflow portion (17) of the secondary air passage (4) is provided in a direction vertical to the furnace wall (18) and the flat plates (17*a*, 17*b*) having the plurality of opening portions (17*aa*, 17*ba*) are arranged, a jet amount of the secondary air in the furnace (11) can be uniformed in the circumferential direction at the outlet portion of the secondary air passage (4), which can contribute to stabilization of flames and improve combustibility, thereby leading to a reduction in CO or unburned combustibles of the fuel. In particular, in the burner (31) that can change a tertiary air flow rate in the tertiary air passage (5) at the outermost peripheral portion depending on the upper and lower sides of the furnace (11), a jet amount of the secondary air at the outlet portion of this secondary air passage (4) can be equalized in the circumferential direction, and this equalization is important in terms of enhancement of flame stabilization.

According to the invention described in the seventh aspect, in addition to the effect of the invention described in the sixth aspect, since the opening portions (17*aa*, 17*ba*) of the flat plates (17*a*, 17*b*) arranged in the combustion gas inflow portion (17) of the secondary combustion gas passage (4) are arranged in such a manner that a flow velocity of the secondary combustion gas becomes uniform in the passage (4) along the circumferential direction, the jet amount of the secondary air at the outlet portion of the secondary combustion gas passage (4) can be uniformed in the circumferential direction, thus enhancing flame stabilization.

According to the invention described in the eighth aspect, in addition to the effect of the invention described in the sixth aspect, a ratio of the maximum flow velocity and the minimum flow velocity of the secondary combustion gas flow velocity becomes 2 or less by setting an opening ratio of each opening portion (17*aa*, 17*ba*) of the flat plates (17*a*, 17*b*) relative to the cross section of the secondary combustion gas inflow portion (17) to 0.05 to 0.30, the flow velocity in the outlet portion of the secondary combustion gas passage (4) in a circumferential direction can be uniformed, and a drift current of the secondary combustion gas flow is no longer present.

According to the invention described in the ninth aspect, in addition to the effect of the invention described in the fifth aspect, since a reduction ratio (its definition will be described later) of the cross-sectional area of the secondary combustion gas passage (4) is set to 30% to 80% from the combustion gas inflow portion (17) of the secondary combustion gas passage (4) toward the outlet portion, the ratio of the maximum flow velocity and the minimum flow velocity does not greatly change and the flow velocity in the outlet portion of the secondary combustion gas passage (4) in a circumferential direction can be hence uniformed, and a drift current of the secondary combustion gas flow is no longer present.

According to the invention described in the tenth aspect, in addition to the invention described in the first aspect, since the flame of the pilot torch (41) can be assuredly detected while maintaining combustion performance of the solid-fuel burner, a malfunction caused by a start-up operation and others in a combustion apparatus or the like including the solid-fuel burner can be eliminated.

BRIEF DESCRIPTION OF DRAWINGS

FIGS. 2(*a*)-2(*d*) show a sectional side elevation (FIG. 2(*a*)) of a pulverized coal burner, a front view (FIG. 2(*b*)) seen from a furnace side, a cross-sectional view taken along an arrow line A-A (FIG. 2(*c*)), and a horizontal sectional view (FIG. 2(*d*)) of the pulverized coal burner according to an embodiment of the present invention.

FIGS. 3(*a*)-3(*d*) show a view (FIG. 3(*a*) is a sectional side elevation) for explaining a flow sate of a pulverized coal main current in a pulverized coal nozzle of the pulverized coal burner, a front view (FIG. 3(*b*)) seen from the furnace side, a horizontal sectional view (FIG. 3(*c*)), and a view (FIG. 3(*d*)) showing a measurement result of a pulverized coal concentration at a pulverized coal nozzle outlet portion in FIG. 2.

BEST MODE(S) FOR CARRYING OUT THE INVENTION

Figures 1A, 1B, 1C, 1D:
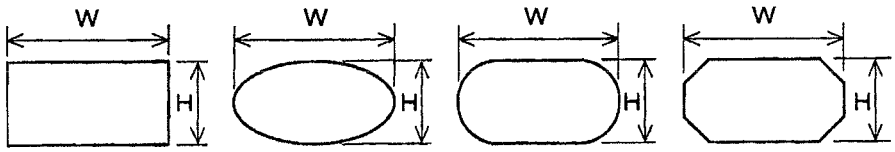
FIGS. 1(*a*)-1(*d*) show various transverse cross-sectional shapes of an opening portion of a pulverized coal nozzle according to an embodiment of the present invention.
Figure 4:
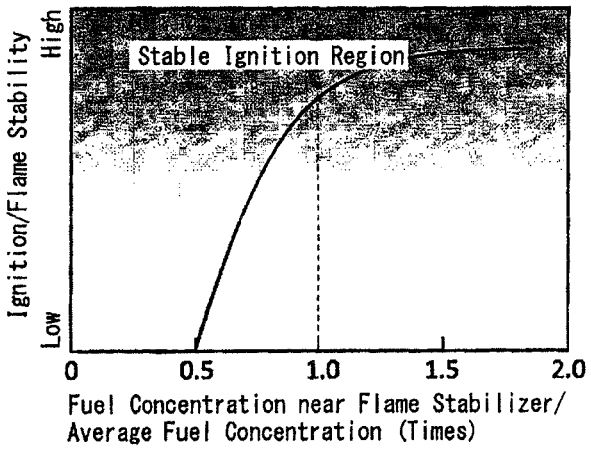
FIG. 4 is a view showing a relationship between fuel concentration/average fuel concentration and ignitability near a flame stabilizer of a general pulverized coal burner.

An embodiment according to the present invention will now be described with reference to the drawings.

FIG. 2 shows the best embodiment of a burner according to the present invention.

An entire configuration of a solid-fuel burner 31 (which may be referred to as a pulverized coal burner 31 hereinafter) will be explained first. In FIG. 2, a start-up burner 1 using an oil or the like as a fuel is installed at the center, a passage 2 of a solid fuel (pulverized coal or the like) carried by a carrier gas (air or the like) is arranged around this burner, a combustion gas (air) is divided into two flows in a wind box 3 to dispose a passage 4 for a secondary combustion gas (which may be referred to as secondary air hereinafter) and a passage 5 for a tertiary combustion gas (which may be referred to as tertiary air hereinafter) around the passage 2. A venturi 7 that once constricts the passage and then expands and a fuel concentrator 6 are provided in the passage 2 for a mixed fluid of the solid fuel and the carrier gas, and a flame stabilizer 9 is installed at an outer periphery of an outlet portion of a fuel nozzle 8 (which may be referred to as a pulverized coal nozzle 8 hereinafter).

FIG. 2(*b*) shows a front view of the pulverized coal burner that is seen from the furnace 11 side. The flame stabilizer 9 is provided in a ring-like form at a tip portion of the pulverized coal nozzle 8 to form a circulation flow on a wake side of the flame stabilizer 9 and enhance ignitability and a flame stabilizing effect. FIG. 2(*b*) shows an example of using the flame stabilizer 9 having shark tooth-like protrusions formed on the pulverized coal nozzle 8 side.

Moreover, shapes of the pulverized coal nozzle 8 and the secondary air nozzle 10 in this pulverized coal burner 31 are flat shapes as seen from the furnace 11 (see FIG. 16) side. The secondary air flows into the secondary air passage 4 from a secondary air inflow portion 17, and the combustion secondary air is supplied to the periphery of the pulverized coal nozzle 8 from an outlet on the boiler furnace 11 side.

A plurality of opening members 13 whose aperture areas can be adjusted are provided in the tertiary air inflow portion 12. Additionally, the tertiary air nozzle 15 at the outlet portion on the furnace 11 side is expanded toward the outer side, and the tertiary air is supplied toward the outer side in the furnace 11.

Particulars of the configuration of the pulverized coal nozzle 8 and an inherent effect provided by this configuration will now be described.

A mixed fluid 21 of the pulverized coal and the carrier gas is led to a burner introducing portion 23 through a fuel carrier piping 22. The mixed fluid passage 2 for the pulverized coal and the carrier gas on the downstream side of the burner introducing portion 23 is constricted by the venturi 7 and then expands. Expansion (H1) of the venturi 7 in the vertical direction falls within the range smaller than an inner diameter (D1) of the pulverized coal nozzle 8 of the burner introducing portion 23, and then upper and lower walls of the pulverized coal nozzle 8 constituting the mixed fluid passage 2 are extended in a straightforward direction toward the furnace 11 (see FIG. 16). Expansion of the mixed fluid passage 2 in the horizontal direction near the venturi 7 continues to a position near the outlet of the pulverized coal nozzle 8, a cross-sectional shape of the pulverized coal nozzle 8 changes from a circular shape into a flat shape in an expansion process, and a degree (a ratio) of flatness gradually increases with the expansion in the horizontal direction. A linear portion of the pulverized coal nozzle 8 horizontally extending from the expanded portion is provided to dispose the flame stabilizer 9, and the expansion of the pulverized coal nozzle 8 in the horizontal direction may continue to the flame stabilizer 9 portion by devising a method for disposing the flame stabilizer 9. The degree (ratio) of flatness is maximum in the outlet portion of the pulverized coal nozzle 8, i.e., a region of the flame stabilizer 9.

FIG. 3 shows a flow of a main current of the pulverized coal in the pulverized coal nozzle 8 from the burner introducing portion 23 to the outlet of the pulverized coal nozzle 8. FIG. 3(*a*) is a longitudinal cross-sectional view of the pulverized coal nozzle 8, and FIG. 3(*b*) is a horizontal cross-sectional view of the pulverized coal nozzle 8. In a flow on the downstream side of the venturi 7 in the pulverized coal nozzle 8, a portion 35 having a spot pattern in FIG. 3 schematically shows a region where the pulverized coal is concentrated.

The mixed fluid of the pulverized coal and the carrier gas becomes a contracted flow toward the center axis C in the constriction process of the venturi 7 and forms an annular flow along a fuel concentrator support tube 24. When this flow reaches the combustion concentrator 6, it changes into an outward flow by an inclined portion of a front surface of the fuel concentrator 6.

It is to be noted that, as a structural example of the fuel concentrator 6, there is one having a conically-shaped front surface inclined portion whose axial cross-sectional area increases with the fuel concentrator support tube 24 as the center axis, a cylindrical parallel portion having substantially the same axial cross-sectional area provided on the wake side, and a conically-shaped rear surface inclined portion whose axial cross-sectional area reduces provided on the further wake side.

The passage in the pulverized coal nozzle 8 in which the rear surface inclined portion is placed may be referred to as an expanded portion of a passage since its cross-sectional area greatly increases.

Even in a case where a flow rate distribution of the pulverized coal in the pulverized coal nozzle 8 is not uniform in the burner introducing portion 23, the fuel is temporarily collected in the direction of the center axis C by the constricting portion of the venturi 7, and then the fuel flow rate distribution in the circumferential direction is equalized in an expansion process using the fuel concentrator 6. In the flow of the pulverized coal expanded by the fuel concentrator 6, a flow of a perpendicular-direction component immediately collides with horizontal portions of the upper and lower inner peripheral walls of the pulverized coal nozzle 8 as shown in FIG. 3(*a*) and is changed into the straightforward direction, a flow of a horizontal-direction component has an outward velocity component given by the inclined portion of the front surface of the fuel concentrator 6 preserved until it reaches the outlet portion of the pulverized coal nozzle 8, and a main current of the pulverized coal keeps expanding even after flowing into the furnace 11 on the downstream side of the outlet of the pulverized coal nozzle 8.

A combination of the configuration of the pulverized coal nozzle 8, the venturi 7, and the fuel concentrator 6 enables increasing the degree (ratio) of flatness of the shape of the pulverized coal flow even after passing the outlet of pulverized coal nozzle 8 and uniforming a fuel concentration distribution near the inner peripheral wall of the pulverized coal nozzle 8 around the flame stabilizer 9.

FIG. 3(*d*) is a view showing measurement result of a pulverized coal concentration at the outlet portion of the pulverized coal nozzle 8 in FIG. 2 and shows also shows an example of measuring a distribution of fuel concentration at the outlet portion of the pulverized coal nozzle 8 according to this embodiment. Fuel concentration/average fuel concentration in a central portion of the pulverized coal nozzle 8 is as low as 0.8 time or less, the fuel concentration increases as getting closer to the outer peripheral portion, and the fuel concentration at the outermost peripheral portion is concentrated to approximately 1.5 time of the average concentration. Additionally, the concentration distribution in the circumferential direction of the pulverized coal nozzle 8 is uniform, and a fuel concentration deviation at the outermost peripheral portion of the pulverized coal nozzle 8 that is closest to the flame stabilizer 9 that plays an important role for, e.g., ignition is suppressed to approximately ±0.1 time in terms of the fuel concentration/average fuel concentration. As described above, since the fuel concentration that is uniform in the circumferential direction of the pulverized coal nozzle 8 is obtained, the stable ignition/flame stability can be provided.

Figure 18:
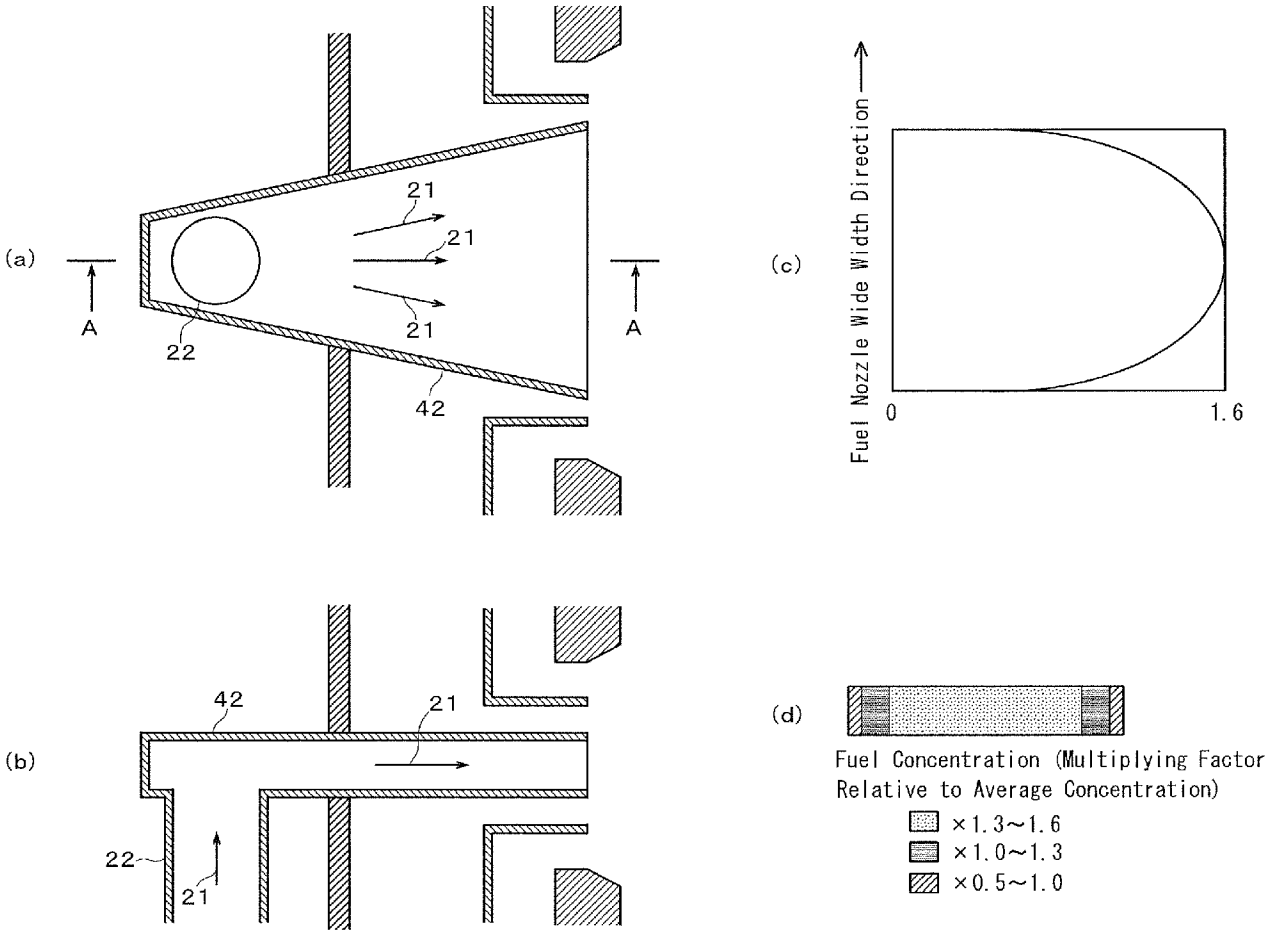
FIGS. 18(*a*)-18(*d*) show a horizontal sectional view (FIG. 18(*a*)) of a nozzle of a pulverized coal burner according to the prior art, a cross-sectional view (FIG. 18(*b*)) taken along an arrow line A-A in FIG. 18(*a*), a view (FIG. 18(*c*)) showing a fuel concentration distribution of a fuel nozzle in FIG. 18(*a*) in a wide width direction as a relative value when average concentration is 1.0, and a view (FIG. 18(*d*)) showing a fuel concentration distribution (region) in a cross section of an outlet opening portion of the pulverized coal nozzle as a relative value when the average concentration is 1.0.

Here, a concentration distribution at an outlet portion of a fuel nozzle 42 according to the prior art shown in FIG. 18, which is not applicable to the combination of the above-mentioned configuration of the pulverized coal nozzle 8, the venturi 7, and the fuel concentrator 6 was examined. It is to be noted that the fuel nozzle 42 in FIG. 18 has a burner shape described in the Patent Literature 1, FIG. 18(*a*) shows a horizontal sectional view of the fuel nozzle 42, and FIG. 18(*b*) shows a cross-sectional view taken along an arrow line A-A in FIG. 18(*a*).

FIG. 18(*c*) is a view showing a fuel concentration distribution in a transverse width direction of the fuel nozzle 42 corresponding to the horizontal sectional view of the fuel nozzle 42 in FIG. 18(*a*) in the form of a relative value when the average concentration is 1.0, and FIG. 18(*d*) is a view showing the fuel concentration distribution (region) in a cross section of an outlet of an opening portion of the pulverized coal nozzle 40 fuel nozzle 42 in the form of a relative value when the average concentration is 1.0.

As described above, in a comparative example shown in FIG. 18, the concentration in the central portion along the horizontal direction (a nozzle wide width direction) is high, the fuel concentration is lowered as distanced toward both of the end portions, and the fuel concentration is decreased to approximately 0.5 time of an average value at both the end portions that are the farthest from the central portion. That is because a flow of air spreads in the horizontal direction like the nozzle shape, whereas the pulverized coal as solid particles is concentrated in the central portion without diffusing in the horizontal direction and others and without spreading along the nozzle shape. Therefore, a horizontally diffusing jet shape like a fuel jet according to the present invention shown in FIG. 3(*c*) cannot be obtained.

Here, even if such a fuel concentrator as shown in the drawings of Patent Literature 1 that concentrates a fuel in the vertical direction of the fuel nozzle 42 over the entire region of the fuel nozzle 42 along the wide width direction is installed, the fuel is concentrated on the upper side and the lower side of the opening portion of the nozzle 42 in the vertical direction, but the pulverized coal concentration is still high in a central portion along the horizontal direction (the transverse width direction) of the nozzle 42, the pulverized coal concentration is lowered as getting distanced toward both end portion sides, and the pulverized coal concentration at both end portions that are farthest from the central portion is still low.

A relationship between the fuel concentration at the outermost peripheral portion of the pulverized coal nozzle 8 and the ignition/flame stability is improved as the fuel concentration increases. Therefore, in case of the pulverized coal nozzle shape shown in FIG. 18, in the outermost peripheral portion of the fuel nozzle 42, the ignition/flame stability is maintained in the central portion where the fuel concentration is 1.3 or more, but the ignitability is lowered at both of the end portions where the fuel concentration/average fuel concentration is 1.0 time or less.

On the other hand, in case of the pulverized coal nozzle shape according to the present invention, the fuel concentration at the outermost peripheral portion of the pulverized coal nozzle 8 is uniformly concentrated to approximately 1.5 time of the average concentration, and the ignitability/flame stability is excellent on the entire circumference of the pulverized coal nozzle 8.

As advantages of concentrating the fuel concentration at the outermost peripheral portion of the pulverized coal nozzle beyond the average concentration and uniformly putting the fuel concentration in the circumferential direction, the following can be considered. The first advantage is that combustion of the solid fuel is facilitated by maintaining the ignitability/flame stability as described above. Facilitating the combustibility enables highly efficient combustion.

The second advantage is that an effect of low-NOx combustion is produced by improving the ignitability/flame stability. In case of the solid fuel burner according to the present invention, a flame formed at the outlet of the pulverized coal nozzle is not immediately mixed with outer peripheral air, e.g., the tertiary air. A circulation region is formed between a fuel jet and an outer peripheral air jet, and there occurs a phenomenon that the gas in the furnace flows back to a portion near the burner. Since the combustion gas stays in this region, oxygen concentration is low, and NOx produced by the flame formed at the outlet of the pulverized coal nozzle is reduced in this region. This state is called a reduction region. Since hastening ignition at the outlet of the pulverized coal nozzle enables sufficiently assuring a staying time in the reduction region, NOx concentration in the combustion gas can be can decreased.

In case of the pulverized coal nozzle shape shown in FIG. 18, the ignitability at the outlet of the fuel nozzle 42 is non-uniform in the circumferential direction, the ignitability/flame stability becomes poor at both of the end portions, the staying time in the reduction region cannot be assured, and the NOx concentration increases. On the other hand, in case of the pulverized coal nozzle shape according to the present invention, since the fuel concentration at the outermost periphery of the pulverized coal nozzle 8 is uniform in the circumferential direction and higher than the average concentration, ignitability/flame stability is excellent, the staying time in the reduction region is sufficiently assured, and hence low-NOx combustion can be achieved.

The secondary air nozzle 10 in the embodiment shown in FIG. 2 according to the present invention will now be described. The secondary air nozzle 10 shown in FIG. 2 has a flat shape that a gap relative to the flame stabilizer 9 is uniform over the entire circumference (see FIG. 2(*c*)).

It is to be noted that, in this embodiment, an inner wall surface of the secondary air nozzle 10 corresponds to the outer peripheral wall of the pulverized coal nozzle 8 (the fuel nozzle).

As shown in FIG. 2(*c*), the gap between the secondary air nozzle 10 and the flame stabilizer 9 is substantially uniform over the entire circumference. Therefore, the secondary air can be uniformly supplied in the circumferential direction in accordance with the uniform fuel concentration distribution formed near the inner peripheral wall of the pulverized coal nozzle 8. That is, since a local fuel/combustion gas flow rate ratio of the fuel in a region having high fuel concentration near the inner peripheral wall of the pulverized coal nozzle 8 and the secondary air on the outer side surrounding the region can be uniformed over the entire circumferential region of the outlet portion of the pulverized coal nozzle 8, optimum combustion can be obtained in the entire circumferential region.

In this embodiment shown in FIG. 2, the tertiary air nozzle 15 has a circular outlet shape, and the tertiary air passage 5 is arranged to vertically interpose the pulverized coal nozzle 8 (see FIG. 2(*c*)). As a result, mixture of the tertiary air and the fuel is suppressed, and the low-NOx combustion is facilitated.

Further, when the outlet shape of the tertiary air nozzle 15 at the outermost periphery of the pulverized coal burner 31 is formed into a circular shape, it is possible to facilitate not only an application as a newly configured burner but also an application to remodeling of an existing burner having a circular opening portion.

A water wall tube constituting a furnace wall surface 18 must be devised to bypass a burner opening portion 32 of the furnace wall surface 18, but a degree of devising becomes prominent as a capacity of the burner 31 is enlarged. If the outlet shape of the tertiary air nozzle 15 at the outermost periphery is a circular shape, to form the burner opening portion 32, a curvature of the water wall tube, which is processed to be curved, can be formed into a relatively large smooth shape. As a result, the water wall tube can be easily processed, concentration of stress at the time of bending can be alleviated, and an increase in resistance of an internal fluid flowing in the water wall tube can be suppressed.

A description will now be given as to a configuration that stabilizes flames by homogenizing a jet of the secondary air from the secondary air nozzle 10 of the secondary air passage 4 in the circumferential direction.

The secondary air passage 4 has a configuration that a cross sectional area of the passage is reduced from the secondary air inflow portion (a secondary air inlet portion) 17 toward a secondary air outlet on the furnace side.

First, an influence of a ratio of a cross-sectional area of the secondary air inflow portion 17 and a cross-sectional area of the secondary air passage 4 near the outlet portion on a flow velocity distribution at the outlet portion of the secondary air passage 4 was examined.

A relationship between the cross-sectional area ratio and the flow velocity distribution at the outlet portion of the secondary air passage 4 was evaluated from an experiment using a fluidity test apparatus uniquely assembled by the present inventors. The apparatus having the same shape as the pulverized coal burner 31 having the outlet shape shown in FIG. 1 was fabricated, and the outlet portion of the secondary air passage 4 was equally divided into 16 parts in the circumferential direction while changing a ratio of the cross-sectional area of the inflow portion 17 and the cross-sectional area near the outlet portion, and a flow velocity at each part was measured by a hot wire anemometer. It is to be noted that air having an ordinary temperature was used as a fluid. As an index representing homogenization of the flow velocity, a ratio of a maximum flow velocity and a minimum flow velocity was taken and evaluated. If the ratio of the maximum flow velocity and the minimum flow velocity is 1, this means that the flow velocity is homogenized.

Figure 8:
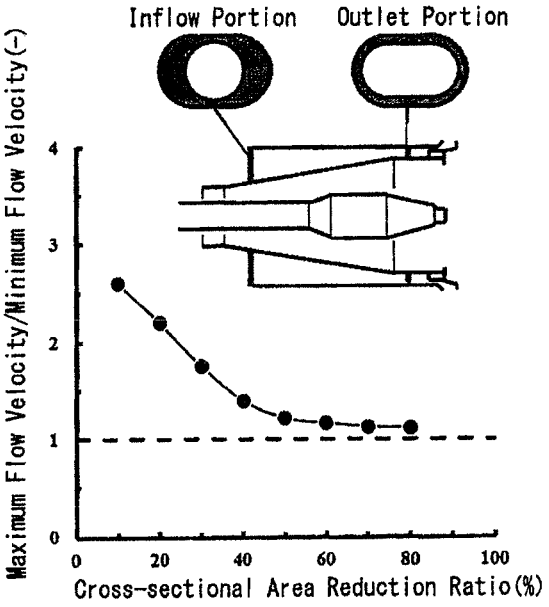
FIG. 8 is a view showing a relationship between a reduction ratio of a cross-sectional area of the secondary air outlet portion relative to a cross-sectional area of the secondary air inlet portion of the pulverized coal burner and a ratio of a maximum flow velocity and a minimum flow velocity in the secondary air passage according to an embodiment of the present invention.

FIG. 8 shows a relationship between a reduction ratio of the cross-sectional area of the secondary air outlet portion relative to the cross-sectional area of the secondary air inflow portion 17 as an evaluation target and the ratio of the maximum flow velocity and the minimum flow velocity in the secondary air passage 4. The cross-sectional area reduction ratio on an axis of abscissa in FIG. 8 is defined as follows. However, the flat plates 17*a* and 17*b* are not installed in the secondary air inflow portion 17 here.

Further, the cross-sectional area of the outlet portion of the secondary air inflow portion 17 is a cross-sectional area in a state where the flame stabilizer 9 is not provided, i.e., just before the secondary air passage is reduced by the flame stabilizer 9.

The cross-sectional area reduction area=(1−the cross-sectional area of the outlet portion/the cross-sectional area of the inflow portion)×100(%)

As a result, the ratio of the maximum flow velocity and the minimum flow velocity is greatly reduced until the reduction ratio reaches approximately 40%, and then the ratio gradually decreases and approximates 1. When the reduction ratio was set to 30% or more, the ratio of the maximum flow velocity and the minimum flow velocity is 2 or less. However, when the cross-sectional area reduction ratio is set to be too high, an amount of the inflow gas is reduced like a later-described aperture ratio, and hence it is desirable to set the reduction ratio of the cross-sectional area of the secondary air passage 4 to 30 to 80%.

Figure 5B:
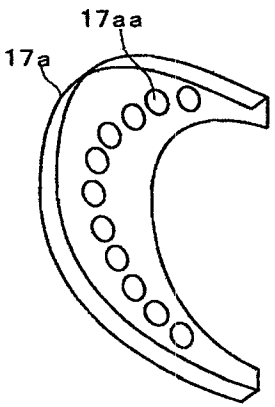
FIGS. 5(*a*) and 5(*b*) show a plan view (FIG. 5(*a*)) of a flat plate provided at an inflow portion of a secondary air passage of the pulverized coal burner according to an embodiment of the present invention and a perspective view (FIG. 5(*b*)) of a half of the flat plate.
Figure 5A:
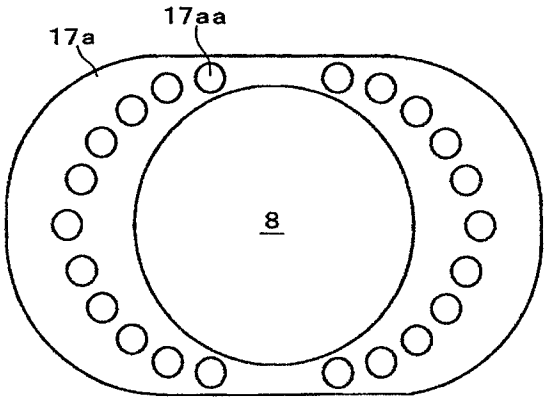

FIG. 5 shows an embodiment concerning a shape of the flat plate 17*a* provided in the secondary air inflow portion 17 of the secondary air passage 4. FIG. 5(*a*) shows a plan view of the flat plate 17*a*, and FIG. 5(*b*) shows a perspective view of a half of the flat plate 17*a*.

Figure 10:
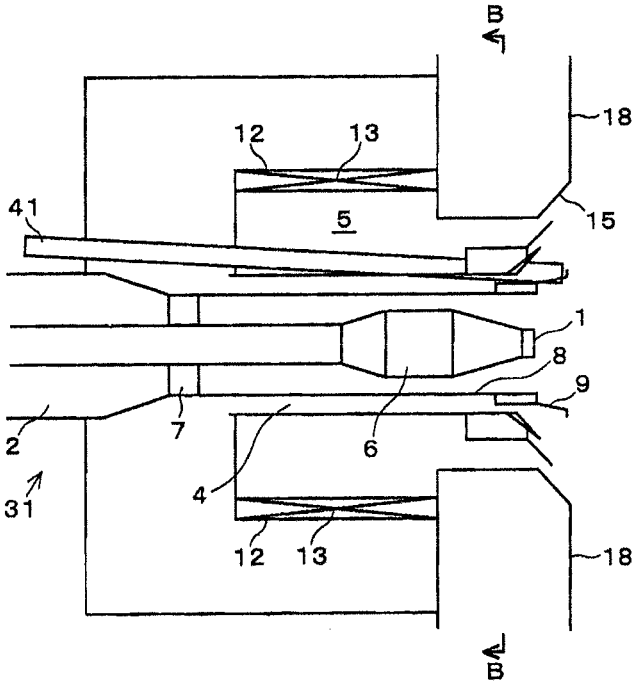
FIG. 10 is a sectional side elevation of the pulverized coal burner according to an embodiment of the present invention.

In the embodiment shown in FIG. 5(*a*), a plurality of circular opening portions•17*aa* are provided in a symmetrical position vertically and horizontally in the flat plate 17*a* having a rounded rectangular shape. It is to be noted that an inner large circular opening portion is a contact portion with the pulverized coal nozzle 8. Furthermore, this flat plate 17*a* has a horizontally half-split structure as shown in FIG. 10(*b*) so that it can be readily disposed. In this embodiment, an aperture ratio of the flat plate 17*a* provided in the secondary air inflow portion 17 is approximately 9%.

Figure 6B:
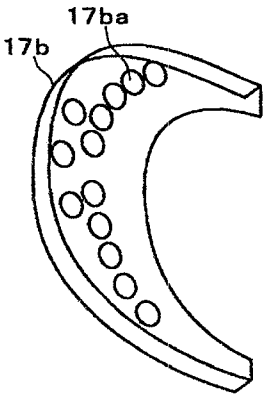
FIGS. 6(*a*) and 6(*b*) show another embodiment of the flat plate provided at the secondary air inflow portion of the pulverized coal burner according to an embodiment of the present invention, where FIG. 6(*a*) is a plan view of the flat plate at the secondary air inflow portion and FIG. 6(*b*) is a perspective view of a half of the flat plate.
Figure 6A:
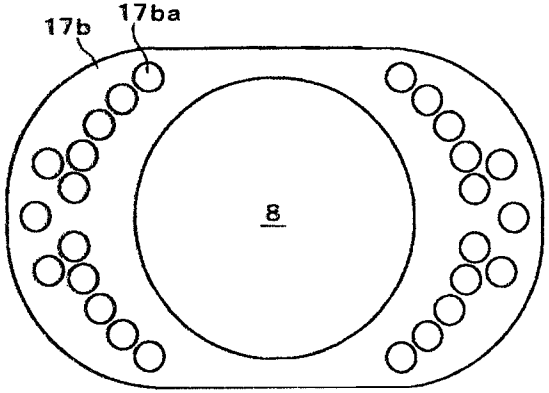

FIG. 6 shows another embodiment of the flat plate arranged in the secondary air inflow portion 17. FIG. 6(*a*) shows a plan view of the flat plate 17*b* provided in the secondary air inflow portion 17, and FIG. 6(*b*) shows a perspective view of a half of the flat plate 17*b*. An aperture ratio of the flat plate 17*b* provided in the secondary air inflow portion 17 is approximately 11%.

It is to be noted that, in the embodiments shown in FIG. 5 and FIG. 6, the opening portions of the flat plates 17*a* and 17*b* provided in the opening portion of the secondary air inflow portion 17 have circular shapes like the opening portions 17*aa* and 17*ba*, but the present invention is not restricted to such shapes, and the opening portions may have polygonal shapes such as an elliptic shape or a square shape. Moreover, the flat plates 17*a* and 17*b* are not restricted to the rounded rectangular shape, and it is possible to adopt various shapes such as a circular shape or an angular shape depending on the configuration of the secondary air inflow portion 17. However, to equalize the flow velocity at the outlet portion of the secondary air passage 4 in the transverse cross-sectional direction, it is desirable to arrange the opening portions of the flat plates 17*a* and 17*b* of the secondary air inflow portion 17 to be vertically and horizontally symmetrical.

Figure 7:
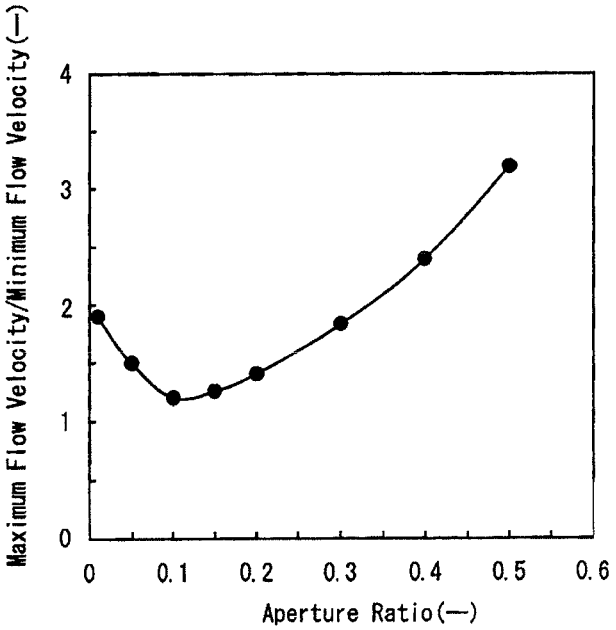
FIG. 7 is a relationship diagram of actual measurement values of an aperture ratio of the secondary air inflow portion of the pulverized coal burner and a flow velocity distribution at an outlet portion of the secondary air passage according to an embodiment of the present invention.

FIG. 7 shows a result of examining the flow velocity distribution at the outlet portion of the secondary air passage 4 in regard to the aperture ratio of each of the flat plates 17*a* and 17*b* of this secondary air inflow portion 17 based on the same fluidity test as that described above. The result shown in FIG. 7 is that the ratio of the maximum flow velocity and the minimum flow velocity at the outlet portion of the secondary air passage 4 is minimum when the aperture ratio is approximately 0.10 and the ratio of the maximum flow velocity and the minimum flow velocity is 2 or less when the aperture ratio is 0.30 or less. However, when the aperture ratio is extremely reduced, an amount of inflow gas is extremely reduced, and hence it is desirable to set the aperture ratio of the secondary air inflow portion 17 to 0.05 to 0.30 in order to uniform the flow velocity at the outlet portion of the secondary air passage 4.

Figure 9A:
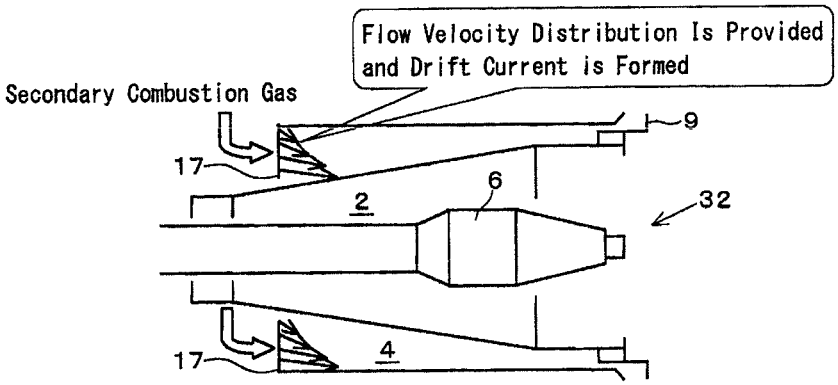
FIGS. 9(*a*) and 9(*b*) show a schematic view of flow velocity distributions in the secondary air inlet portion when the flat plate is not installed at the secondary air inlet portion of the secondary air passage of the pulverized coal burner (FIG. 9(*a*)) and when the same is installed (FIG. 9(*b*)) according to an embodiment of the present invention.
Figure 9B:
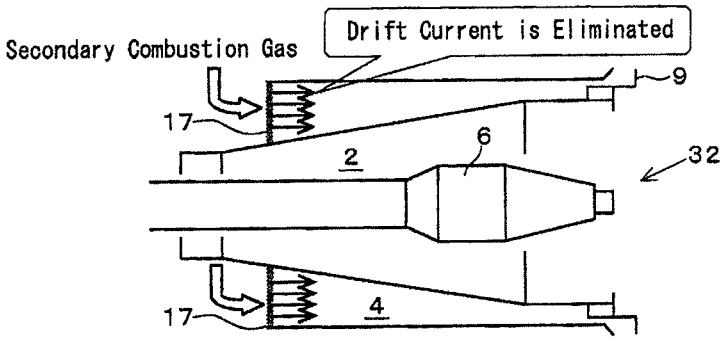

FIG. 9 shows schematic views when the flat plates 17*a* and 17*b* having the opening portions 17*aa* and 17*ba* depicted in FIG. 5 or FIG. 6 are not disposed in the secondary air inlet portion 17 of the secondary air passage 4 (FIG. 9(*a*)) and when the flat plates 17*a* and 17*b* are disposed (FIG. 9(*b*)). A flowing direction and strength of the secondary air are represented by a direction and a length of each arrow.

In a case where the flat plates 17*a* and 17*b* are not disposed as shown in FIG. 9(*a*), when the secondary air flows into the secondary air inlet portion 17 of the secondary air passage 4, it becomes a drift current depending on a direction of a gas flow in the wind box 3 (in the example shown in FIG. 9, the secondary air is supplied from the upper left side), and the flow velocity distribution differs in the cross section of the secondary air inlet portion 17. Such a drift current or a flow velocity distribution affects the flow velocity distribution in the secondary air outlet portion. On the other hand, in a case where the flat plates 17*a* and 17*b* having the opening portions 17*aa* and 17*ba* of the secondary air inlet portion 17 are disposed as shown in FIG. 9(*b*), a difference in the drift current or the flow velocity distribution is eliminated by resistance of the flat plates 17*a* and 17*b*, and a straightforward current having a substantially uniform flow velocity alone is provided as an air current flowing into the secondary air inlet portion 17.

A description will now be given as to a configuration where a flame detector (FD) 40 is disposed in the secondary air nozzle 10 to detect a flame from the ignition burner 1 or a pulverized coal flame at the outlet of the burner 31. Additionally, the pilot torch 41 is provided to assuredly ignite the ignition burner 1.

Figure 11:
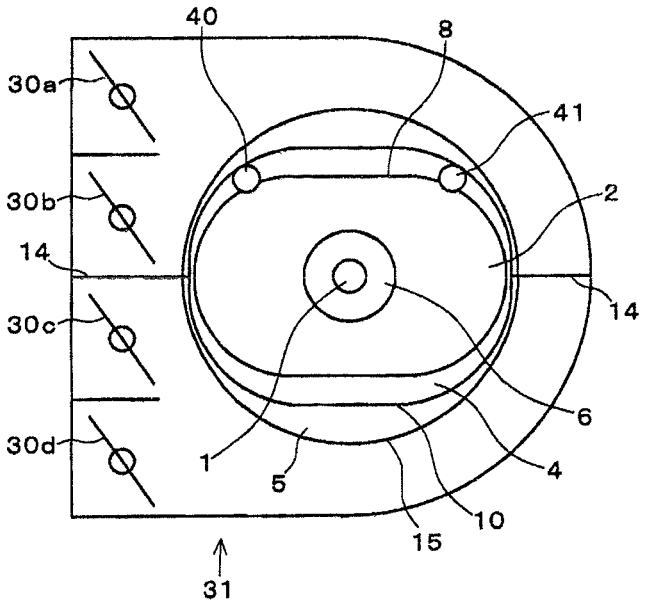
FIG. 11 is a cross-sectional view taken along an arrow line B-B in FIG. 10.

FIG. 10 shows a sectional side elevation of the pulverized coal burner 31 according to an embodiment of the present invention, and FIG. 11 is a cross-sectional view taken along an arrow line B-B in FIG. 10. It is to be noted that FIG. 10 is the same as the sectional side elevation of the pulverized coal burner 31 depicted in FIG. 2, but some members are omitted in the drawing.

An outlet shape of the pulverized coal nozzle 8 of the pulverized coal burner 31 shown in FIG. 10 and FIG. 11 is a rectangular shape having a short diameter portion and a long diameter portion, an elliptic shape, or a substantially elliptic shape having a linear portion and a circular portion, its outer peripheral portion has an elliptic or substantially elliptic secondary air nozzle 10, and a shape of the tertiary air nozzle 15 at the outer periphery has the same concentric shape as the ignition (start-up) burner 1.

A partition plate 14 that vertically divides a burner center horizontal cross section is inserted into the tertiary air nozzle 15 so that tertiary air flow rates that is put into the upper and lower side can be changed.

That is, the partition plate 14 is disposed with respect to the outer peripheral wall of the secondary air nozzle 10 and the inner peripheral wall of the tertiary air nozzle 15, and the tertiary air passage 5 is vertically divided into two pieces by the partition plate 14. The partition plate 14 is also a partition plate 14 that vertically divides the wind box 3 into two pieces. Therefore, when tertiary air amounts from the wind box 3 that is led to the vertically split in two tertiary air passages 5 are adjusted by respective dampers 30*a* to 30*d*, a momentum of the combustion air flowing through each passage can be deviated, and a flame ejected from the pulverized coal burner 31 can be deflected along the vertical direction in the furnace 11.

The FD 40 and the pilot torch 41 are disposed in the upper secondary air nozzle 10 of the pulverized coal nozzle 8. The FD 40 is intended to detect a flame from the ignition burner 1 disposed at the central portion of the burner 31 or a pulverized coal, the flame from the burner 31 disposed on the front and the rear sidewall surfaces 18 of the boiler furnace 11 is upwardly bent by buoyancy and an ascending current, and hence disposing the FD 40 on the upper side of the horizontal line including the burner center is desirable.

Further, since the FD 40 is also intended to detect a flame of the pilot torch 41, disposing the FD 40 and the pilot torch 41 on the same plane is desirable, and hence likewise disposing the pilot torch 41 on the upper side of the horizontal line including the burner center is also desirable.

Since the pipe is inserted into each of the combustion air nozzles 10 and 15, the FD 40 or the pilot torch 41 obstructs a flow of the outer peripheral air depending on a disposing position. Since a cross-sectional area of the jetting port of the secondary air nozzle 10 increases at the outer periphery of the long-diameter portion of the pulverized coal nozzle 8, the outer peripheral wall of the long-diameter portion has a higher flow rate of the secondary air than the outer periphery of the short-diameter portion.

When the FD 40 or the pilot torch 41 is disposed on the outer peripheral wall of the short-diameter portion of the pulverized coal nozzle 8, the flow of the combustion air is obstructed, and hence the air does not flow on the outer peripheral wall of the short-diameter portion.

In this case, nothing cools the FD 40 or the pilot torch 41, and hence there is concern that the FD 40 or the pilot torch 41 is burned out due to radiant heat from the furnace 11. On the other hand, since the outer peripheral wall of the long-diameter portion of the pulverized coal nozzle 8 has a high air flow rate, a possibility of burnout is lowered but, in case of, e.g., the pilot torch 41, a torch flame for the ignition burner 1 is blown out when a flow rate of the combustion air is high, and hence it is undesirable to dispose such a member at a position where an amount of the combustion air is large.

To assuredly ignite the ignition burner 1, it is desirable to dispose the pilot torch 41 at a position where the combustion air flow rate is low.

Although it is desirable to dispose the FD 40 at a position where the amount of the combustion air is large in terms of prevention of burnout, a region with high fuel concentration is formed at each of both ends of the outlet when the outlet shape of the pulverized coal nozzle 8 is a rectangular shape, an elliptic shape, or a substantially elliptic shape, and hence installing the FD 40 so as to see the region with high fuel concentration leads to excellent flame detection sensitivity.

Therefore, it is desirable to dispose the FD 40 or the pilot torch 41 in a region having a small amount of the combustion air and high fuel concentration and also a region where the possibility of burnout can be reduced.

The embodiment shown in FIG. 11 is an example where the outlet shape of the pulverized coal nozzle 8 is a substantially elliptic shape having linear portions and circular portions, an outer peripheral wall of the linear portion has the wide secondary air passage 4, an outer periphery of each circular portion has the narrow secondary air passage 4, and hence it is desirable to dispose the FD 40 or the pilot torch 41 on a contact point of the linear portion and the circular portion.

Figure 12:
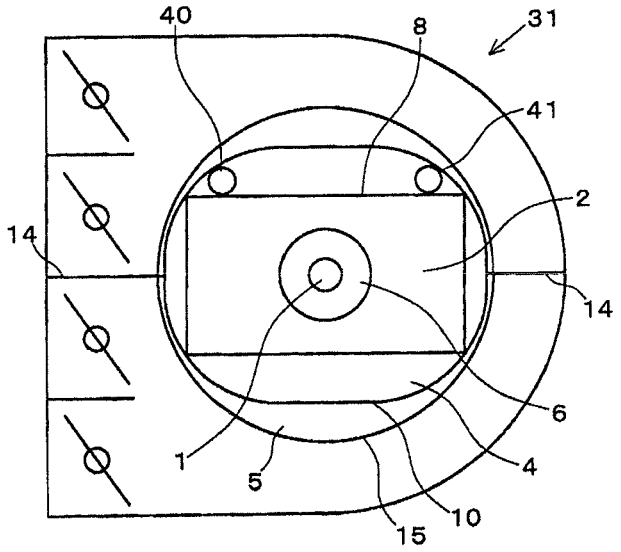
FIG. 12 shows a modification (a cross-sectional view taken along the arrow line B-B in FIG. 10) of the pulverized coal burner according to an embodiment of the present invention.

An embodiment shown in FIG. 12 (a cross-sectional view taken along an arrow line B-B in FIG. 10) corresponds to a case where the outlet shape of the pulverized coal nozzle 8 is a rectangular shape, the secondary air passage 4 on the long-diameter portion side is wide, and the secondary air passage 4 on the short-diameter portion side is narrow. Therefore, it is undesirable to install the FD 40 or the pilot torch 41 at the center of the long-diameter portion or the short-diameter portion of the outlet shape of the pulverized coal nozzle 8, and it is desirable to install such a member on each of both ends of the long-diameter portion.

Figure 13:
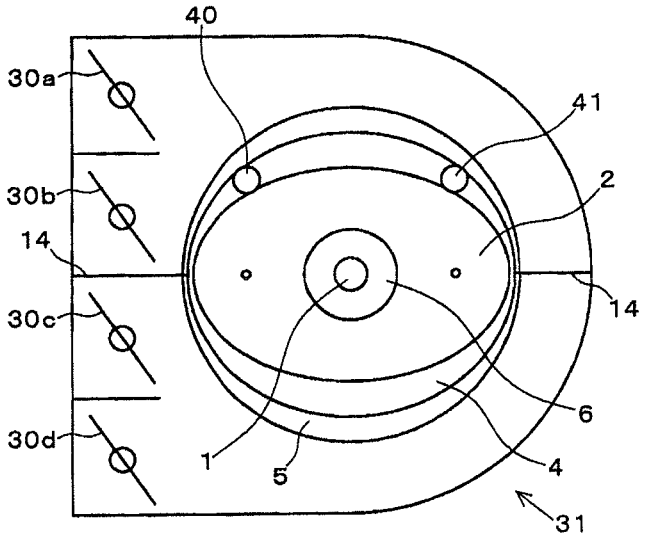
FIG. 13 shows a modification (a cross-sectional view taken along the arrow line B-B in FIG. 10) of the pulverized coal burner according to an embodiment of the present invention.

An embodiment shown in FIG. 13 (a cross-sectional view taken along an arrow line B-B in FIG. 10) corresponds to a case where the outlet shape of the pulverized coal nozzle 8 is an elliptic shape, an outer periphery between focuses has the wide secondary air passage 4, and an outer peripheral wall outside the focuses has the narrow secondary air passage 4. Therefore, in this case, it is desirable to dispose the FD 40 or the pilot torch 41 on the outer peripheral wall outside the focuses of the pulverized coal nozzle 8.

It is to be noted that, in FIG. 11 to FIG. 13, the FD 40 is disposed on the upper left side and the pilot torch 41 is disposed on the upper right side when the pulverized coal burner 31 is seen from the furnace 11 side, but no problem occurs even if their positions are the contrary.

Figure 14:
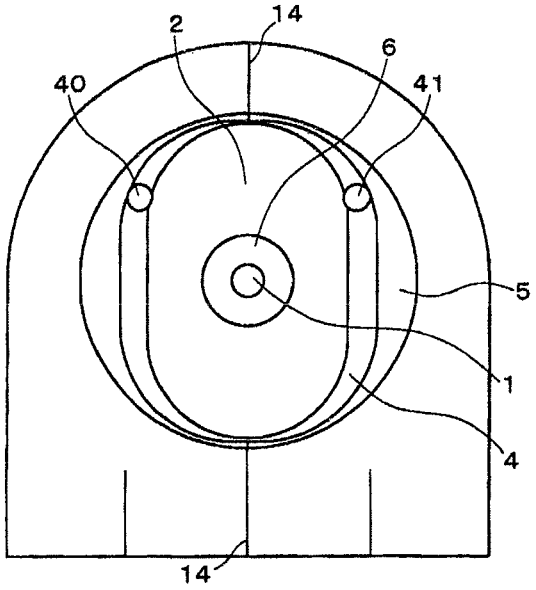
FIG. 14 shows a modification (a cross-sectional view taken along the arrow line B-B in FIG. 10) of the pulverized coal burner according to an embodiment of the present invention.

An embodiment shown in FIG. 14 (a cross-sectional view taken along an arrow line B-B in FIG. 10) corresponds to an example when the burner shown in FIG. 11 is rotated by 90 degrees. That is, this is an example where circular portions constituting an outer peripheral wall of the outlet of the pulverized coal nozzle 8 are placed on upper and lower sides and linear portions are placed on left and right sides. In this case, it is desirable to dispose the FD 40 or the pilot torch 41 on the upper side of the horizontal line including the center of the burner 31.

Figure 15A:
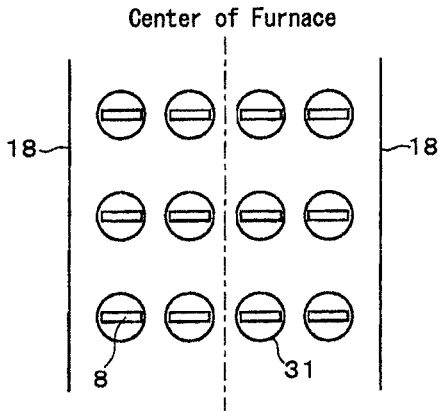
FIGS. 15(*a*) and 15(*b*) show views (FIG. 15(*a*), FIG. 15(*b*)) showing arrangement examples of the pulverized coal burners on a furnace wall according to an embodiment of the present invention.
Figure 15B:
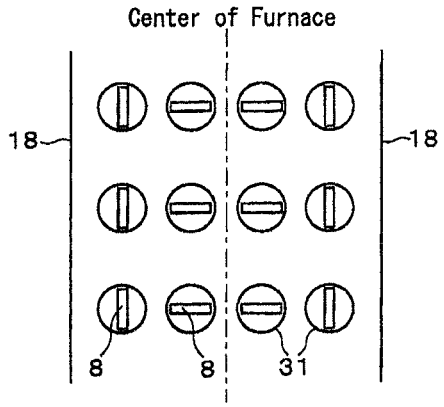
Figure 16A:
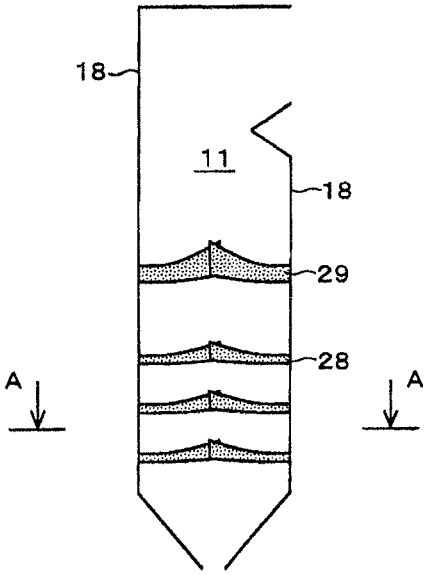
FIGS. 16(*a*) and 16(*b*) show a sectional side elevation (FIG. 16(*a*)) of an entire furnace in which the burners in FIG. 15(*a*) are arranged and a cross-sectional view (FIG. 16(*b*)) taken along an arrow line A-A in FIG. 16(*a*).
Figure 16B:
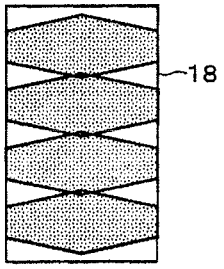

FIG. 15(*a*) shows an arrangement example of the burners 31 according to an embodiment of the present invention on the furnace wall surface 18. In this example, the burners are arranged on three rows and four columns on the furnace wall surface 18, and a wide width direction of the pulverized coal nozzle 8 having a flat shape is determined to be horizontal in light of a total number of the burners. FIG. 16 shows views for schematically illustrating that a space in the furnace 11 can be effectively exploited when the pulverized coal burners 31 depicted in FIG. 15(*a*) are used as compared with the application of the prior art, FIG. 16(*a*) shows a sectional side elevation of the entire furnace 11 in which the burners 31 in FIG. 15(*a*) are arranged, and FIG. 16(*b*) shows a cross-sectional view taken along an arrow line A-A in FIG. 16(*a*). Furthermore, FIG. 17 (FIG. 17(*a*) shows a sectional side elevation of the entire furnace 11 in which the burners having the pulverized coal nozzles each having a transverse sectional shape that is circular shape rather than a flat shape are arranged and FIG. 17(*b*) shows a cross-sectional view taken along an arrow line A-A) shows a configuration of the prior art.

As shown in FIG. 16, when all the pulverized coal burners 31 are arranged while horizontally setting the wide width direction of each pulverized coal nozzle 8 having the flat shape, a fuel jet is dispersed in the horizontal direction in the furnace 11, a space in the furnace 11 can be effectively exploited, and the fuel can be combusted with high efficiency and low-NOx concentration.

Figure 17A:
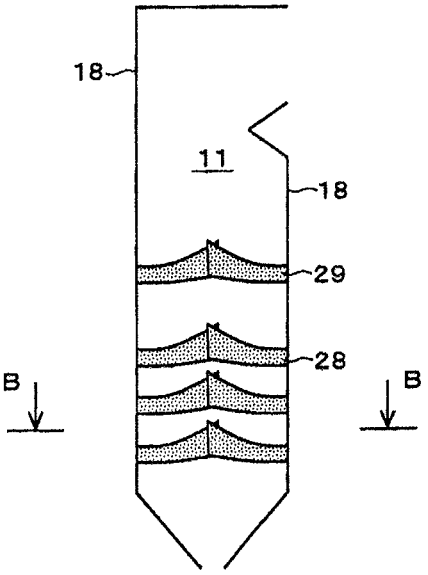
FIGS. 17(*a*) and 17(*b*) show a sectional side elevation (FIG. 17(*a*)) of the entire furnace in which burners each having an pulverized nozzle whose transverse cross section has a circular shape in place of a flat shape according to the prior art are arranged and a cross-sectional view (FIG. 17(*b*)) taken along an arrow line B-B in FIG. 17(*a*).
Figure 17B:
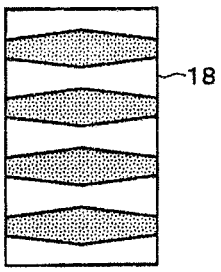

As shown in FIG. 16(*a*) and FIG. 16 (*b*), when all the burners 31 arranged on the furnace wall surface 18 are arranged while horizontally setting the wide width direction of the pulverized coal nozzles 8 each having the flat shape, a flame horizontally spreads in the furnace 11 as compared with the prior art shown in FIG. 17, thereby reducing an unexploited space in the furnace.

That is, according to this embodiment, an area of the cross section through which the flame passes increases in the horizontal cross section in the furnace 11, a time that the flame stays in the furnace 11 increases, the fuel efficiency is improved, and the NOx concentration of the combustion gas can be reduced.

As described above, in case of the fuel nozzle 42 of the prior art shown in FIG. 18(*a*) and FIG. 18(*b*) that does not correspond to the combination of the configuration of the pulverized coal nozzle 8, the venturi 7, and the fuel concentrator 6 in the present invention, a low fuel concentration distribution is provided at both of the end portions in the horizontal direction as shown in FIG. 18(*c*) and FIG. 18(*d*). Therefore, it is difficult to diffuse the fuel toward the outside beyond the spread (an inclination angle relative to the center axis) in the horizontal direction in the furnace, especially the width direction of the fuel nozzle 42 and to spread the flame in the horizontal direction.

As compared with this, in the embodiment according to the present invention, not only the pulverized coal fuel is simply concentrated on the partition side (its vicinity if the flame stabilizer 9 is disposed) of the pulverized coal nozzle 8 and the secondary air nozzle 10 at the outer periphery thereof and the ignition can be uniformly performed over the entire circumference of the opening portion of the pulverized coal nozzle 8, but also the fuel distribution (a value obtained by integrating the fuel in an up-and-down direction at a specific horizontal position) on the horizontal cross section of the pulverized coal nozzle 8 (when the burner 31 is seen from an up-and-down direction side) is high on both of the end portion sides rather than the vicinity of the central portion in the horizontal direction (a nozzle wide width direction).

Therefore, the fuel can be diffused toward the outer side beyond the spread (an inclination angle relative to the center axis C) in the horizontal direction in the furnace, especially the width direction of the pulverized coal nozzle 8, and the flame can be spread in the horizontal direction.

Therefore, even if a capacity of a single burner rises and a distance between the burners 31 adjacent to each other in the furnace along the horizontal direction increases, the furnace space can be effectively used without increasing a region where no flame is formed.

FIG. 15(*b*) shows an arrangement example of the burners 31 according to another embodiment of the present invention. In this embodiment, the burners 31 are arranged on three rows and four columns on the furnace wall surface 18, the burners 31 close to the side walls where a problem of adhesion of ash to the furnace wall surface 18 is apt to occur are arranged in such a manner that the wide width direction of each pulverized coal nozzle 8 faces a vertical direction, other burners 31 are arranged while setting the wide width direction of pulverized coal nozzle 8 having the flat shape to the horizontal direction, and combustion can be carried out with high efficiency and low-NOx concentration while suppressing the problem of the adhesion of ash. In this embodiment, although the burners 31 close to the side walls are arranged in such a manner that the wide width direction of each pulverized coal nozzle 8 having the flat shape faces the vertical direction, the wide width direction of each pulverized coal nozzle 8 having the flat shape may be arranged to be the vertical direction as regards some of the burners 31 close to the side walls (e.g., the burners 31 on the uppermost stage alone), and the wide width direction of each pulverized coal nozzle 8 having the flat shape may be arranged to face horizontal direction as regards the other burners 31.

It is to be noted that, in the arrangement example of the burners 31 shown in FIG. 15(*a*) and FIG. 15(*b*), the wide width direction of each pulverized coal nozzle 8 having the flat shape is set perfectly to the vertical direction or the horizontal direction, but it may be arranged with an inclination if the wide width direction cannot be perfectly set to the vertical direction or the horizontal direction due to an influence of any other structures around each burner 31.

REFERENCE SIGNS LIST

1 start-up burner
2 passage of pulverized coal
3 wind box
4 passage of secondary air
5 passage of tertiary air
6 fuel concentrator
7 venturi
8 pulverized coal nozzle
9 flame stabilizer
10 secondary air nozzle
11 furnace
12 tertiary air inflow portion
13 tertiary opening member
14 partition plate
15 tertiary air nozzle
17 secondary air inflow portion
18 furnace wall surface
21 mixed fluid
22 fuel carrier piping
23 burner introducing portion
24 fuel concentrator support tube
28 burner flame
29 two-staged combustion gas supply port
31 solid-fuel (pulverized coal) burner
32 furnace opening portion (burner throat portion)
40 flame detector
41 pilot torch
42 fuel nozzle

What is claimed is:

1. A solid-fuel burner comprising:

a fuel nozzle that opens into an opening portion of a furnace wall, the fuel nozzle comprising:

a solid-fuel passage;

a venturi, having a constricting portion with an outlet, that reduces a transverse cross section of the solid-fuel passage in the fuel nozzle;

an upper wall and a lower wall that each extend in a straightforward direction toward the furnace wall from the outlet of the constricting portion of the venturi to the opening portion of the furnace wall; and a fuel concentrator that diverts flow in the fuel nozzle outward on a wake side of the venturi, a cylindrical fuel carrier piping, through which a mixed fluid of a solid fuel and a carrier gas for the solid fuel is configured to flow, is connected to the solid-fuel passage of the fuel nozzle;

at least one combustion gas nozzle is provided on an outer peripheral wall side of the fuel nozzle; and a wind box, in which a combustion gas for the solid fuel is configured to flow, is provided on the outer peripheral wall side of the fuel nozzle and is in fluid communication with the at least one combustion gas nozzle, wherein the fuel nozzle has a cross-sectional shape orthogonal to a nozzle center axis of an outer peripheral wall of the fuel nozzle, the cross-sectional shape of the fuel nozzle is flattened at an opening of the fuel nozzle proximate to the opening portion in the furnace wall, the cross-sectional shape of the fuel nozzle is circular up to the constricting portion of the venturi, a degree of flatness of the cross-section shape of the fuel nozzle and a width of the fuel nozzle in a horizontal direction gradually increases from the constricting portion of the venturi to the opening of the fuel nozzle and reach a maximum degree of flatness and a maximum width in the horizontal direction at the opening of the fuel nozzle, and the upper wall and the lower wall of the fuel nozzle are spaced from each other by a constant predetermined distance from the outlet of the constricting portion of the venturi to the opening portion of the furnace wall.

2. The solid-fuel burner according to claim 1, wherein a flame stabilizer is disposed at an outer periphery of a tip of the outer peripheral wall of the fuel nozzle.

3. The solid-fuel burner according to claim 1, wherein the at least one combustion gas nozzle is a secondary combustion gas nozzle of a plurality of combustion gas nozzles, and a secondary combustion gas passage is provided in the secondary combustion gas nozzle disposed on an innermost side of the plurality of combustion gas nozzles and has a cross-sectional shape orthogonal to a center axis of an outer peripheral wall of the secondary combustion gas nozzle, the cross-sectional shape of the secondary combustion gas nozzle is flattened at an outlet portion of the secondary combustion gas passage.

4. The solid-fuel burner according to claim 3, wherein the plurality of combustion gas nozzles includes a tertiary combustion gas nozzle, and a tertiary combustion gas passage is provided in the tertiary combustion gas nozzle and is disposed on an outermost side in the plurality of combustion gas nozzles and has a cross-sectional shape orthogonal to a center axis of an outer peripheral wall of the tertiary combustion gas nozzle, the cross-sectional shape of the tertiary combustion gas nozzle is circular at an outlet portion of the tertiary combustion gas passage near the furnace wall.

5. The solid-fuel burner according to claim 3, wherein the cross-sectional area of the secondary combustion gas passage is sequentially reduced from a combustion gas inflow portion of the secondary combustion gas passage toward the opening portion in the furnace wall.

6. The solid-fuel burner according to claim 5, wherein a gas inflow direction of the combustion gas inflow portion of the secondary combustion gas passage is a direction vertical to the furnace wall, and a flat plate having a plurality of opening portions is arranged in the combustion gas inflow portion of the secondary combustion gas passage.

7. The solid-fuel burner according to claim 6, wherein the plurality of opening portions of the flat plate arranged in the combustion gas inflow portion of the secondary combustion gas passage are arranged in such a manner that a flow velocity of the combustion gas in the secondary combustion gas passage becomes uniform in a circumferential direction of the passage.

8. The solid-fuel burner according to claim 6, wherein an aperture ratio of the plurality of opening portions of the flat plate relative to a cross-sectional area of the combustion gas inflow portion of the secondary combustion gas passage is 0.05 to 0.30.

9. The solid-fuel burner according to claim 5, wherein a reduction ratio of a cross-sectional area of the secondary combustion gas passage from the combustion gas inflow portion to the outlet portion of the secondary combustion gas passage is 30% to 80%.

10. The solid-fuel burner according to claim 1, wherein a flame detector and a pilot torch are disposed on one of:

respective ends of an outlet of the fuel nozzle that emits the solid fuel and the solid fuel carrier gas when the outlet of the fuel nozzle is a rectangular shape, respective focuses when the outlet of the fuel nozzle is an elliptical shape, and on respective ends of a linear portion when the outlet of the fuel nozzle is a substantially elliptical shape having the linear portions and circular portions.

* * * * *